United States Patent [19]

Kuo

[11] Patent Number: 4,817,226

[45] Date of Patent: Apr. 4, 1989

[54] ROTATIVELY RUBBING ERASER

[76] Inventor: Fu-Ching Kuo, P.O. Box 10160, Taipei, Taiwan

[21] Appl. No.: 183,936

[22] Filed: Apr. 20, 1988

[51] Int. Cl.[4] ..... B43L 19/00

[52] U.S. Cl. ..... 15/3.53; 15/26

[58] Field of Search ..... 15/22 R, 3.53, 26, 28, 15/429, 430, 433

[56] References Cited

U.S. PATENT DOCUMENTS 2,074,255 3/1937 Dodson ..... 15/3.53
2,171,308 8/1939 King ..... 15/26

FOREIGN PATENT DOCUMENTS 70066 9/1949 Denmark ..... 15/3.53
715778 12/1931 France .

*Primary Examiner*—Edward L. Roberts

[57] ABSTRACT

An eraser includes: a guiding holder having a pair of helical grooves formed inside the holder, and a sleeve holding an eraser stick in the sleeve having a pair of protruding beads formed on the sleeve helically engaging the pair of helical grooves in the holder, whereby upon a depression of the holder against a marking paper, the eraser as held in the sleeve is helically rotated to rotatively rub out a mark on the paper.

4 Claims, 2 Drawing Sheets

ROTATIVELY RUBBING ERASER

BACKGROUND OF THE INVENTION

When using a conventional rubber eraser for erasing a mark made on a paper, the rubber eraser is held by a user's hand to reciprocatively laterally rub the mark, which however may even rub out the neighboring words adjacent to the mark.

It is therefore expected to invent a pen-like eraser which may be vertically held by a user's hand to rotatively rub a mark found on a paper around a vertical axis of the eraser without rubbing out any other neighboring words or contents as written or printed on a paper.

SUMMARY OF THE INVENTION

The object of the present invention is to provide an eraser including a guiding holder having a pair of helical grooves formed inside the holder, and an intermediate sleeve means holding an eraser stick in the sleeve means having a pair of protruding beads helically engaging the pair of helical grooves in the holder, whereby upon a depression of the holder against a marking paper, the eraser as held in the sleeve means is helically rotated to rotatively rub out a mark existing on the paper, without erasing any other neighboring words or contents originally written or printed on the paper.

DETAILED DESCRIPTION

Figure 1:
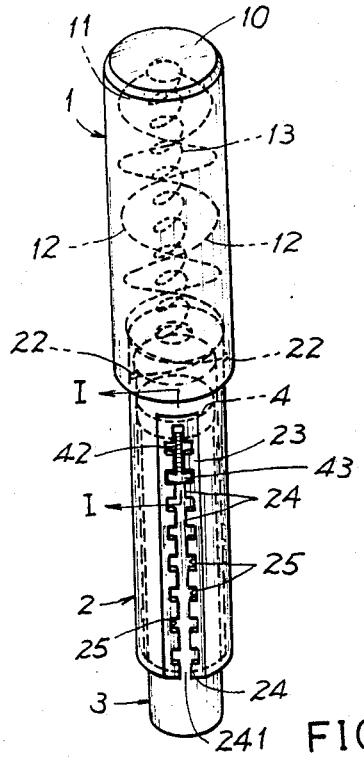
FIG. 1 is a perspective illustration of the present invention.
Figure 2:
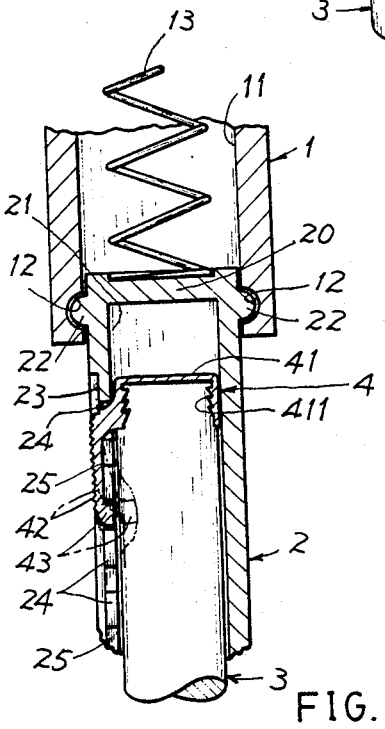
FIG. 2 is a partial longitudinal sectional drawing of the present invention as viewed from I—I direction of FIG. 1.
Figure 3:
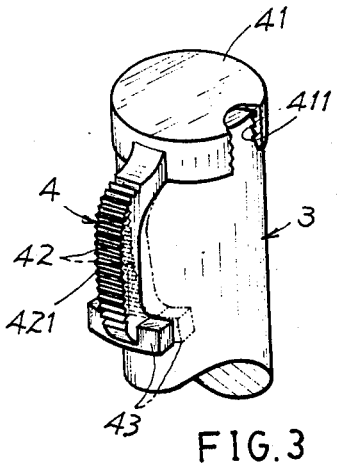
FIG. 3 shows an eraser stick in combination with an eraser positioning means in accordance with the present invention.

As shown in FIGS. 1-3, the present invention comprises: a guiding holder 1, an intermediate sleeve means 2, an eraser stick 3, and an eraser positioning means 4.

The guiding holder 1 generally formed as a cylindrical jacket has a cylindrical hole 11 formed inside the cylindrical jacket, having a top-end plate 10 formed on a top portion of the holder 1 for sealing the hole 11 and having a pair of helical grooves helically formed in a cylindrical wall defining cylindrical hole 11. A restoring spring 13 is secured to the top-end plate 10 inside the holder 1.

The intermediate sleeve means 2 is generally formed as a cylindrical tube, having a cylindrical hole 21 formed inside the tube and limited by a upper disk portion 20 on a top end of the tube, a pair of protruding beads 22 formed on two opposite sides of the upper disk portion 20 slidingly engaged with the pair of helical grooves 12 formed in the holder 1, a longitudinal flat portion 23 longitudinally formed on the cylindrical tube of the sleeve means and recessed from a cylindrical circumference of the sleeve means (as shown in FIG. 2), a longitudinal slot 24 longitudinally formed in the cylindrical tube within the longitudinal flat portion 23 with a lowest opening 241 directly cut across a tube wall of the lowest edge of the cylindrical tube, and a plurality of latch slots 25 each transversely formed in the cylindrical tube within the flat portion 23 to laterally intersect the longitudinal slot 24.

The eraser stick 3 is made of rubber or other eraser materials and is generally formed as a cylindrical rod having its top end portion secured on the eraser positioning means 4 to be held in the sleeve means 2 and having its lower end portion protruding downwardly beyond the sleeve means 2.

The eraser positioning means 4 includes: a retainer member 41 having ratchet teeth 411 for firmly securing a top end portion of the eraser stick 3 to the retainer member 41, a resilient arm member 42 having its upper end secured to the retainer member 41 and having its middle porion formed as a bow-shaped handle 421 protruding outwardly from the the retainer member 41 and having its lower portion secured with a latch 43 operatively engageable with each latch slot 25 formed in the sleeve means 2.

In assembling the elements of the present invention, the following procedures can be taken to form a complete eraser set;

1. The eraser stick 3 is secured to the retainer member 41 of the eraser positioning means 4.

2. The eraser stick 3 with the eraser positioning means 4 is inserted into the cylindrical hole 21 of the sleeve means 2 by passing the arm member 42 through the longitudinal slot 24 of the sleeve means 2 and by depressing the arm member 42 and latch 43 of the positioning means 4 against the rubber eraser 3 to squeeze the rubber eraser inwardly as shown in dotted line of FIG. 2 so that the latch 43 will not be obstructed by the plural slots 25 to allow an upward movement of the eraser 3 toward an uppermost end of the sleeve hole 21, whereby upon the releasing of the arm member 42, the resilience of the bow-shaped arm member 42 will resiliently extend the latch 43 to engage with a latch slot 25 of the sleeve means 2.

3. The sleeve means 2, having its two beads 22 engaged with the two helical grooves 12 of the guiding holder 1, is inserted into the guiding holder 1 wherein the restoring spring 13 is tensioned between the top-end plate 10 of the holder 1 and the upper disk portion 20 of the sleeve means 2 to normally force the sleeve means 2 outwardly from the holder 1 by merely holding the upper disk portion 20 within a lower periphery of the holder 1.

Figure 5:
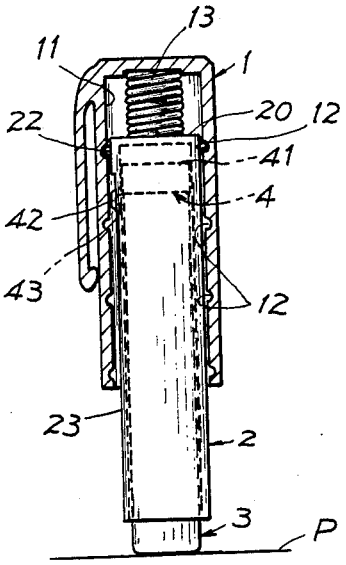
FIG. 5 is a partial sectional drawing of the present invention, as assembled.

The width of the arm member 42 should be slightly smaller than a width of longitudinal slot 24 for adjusting the position of eraser 3 in the sleeve 2. The arm member 42 extending outwardly from the secured eraser stick 3 should not be projectively beyond a diameter of the upper disk portion 20 of the sleeve means 2 so that the sleeve means 2 with an internally embedded eraser 3 can be helically rotated within the holder hole 11 as shown in FIG. 5.

Figure 4:
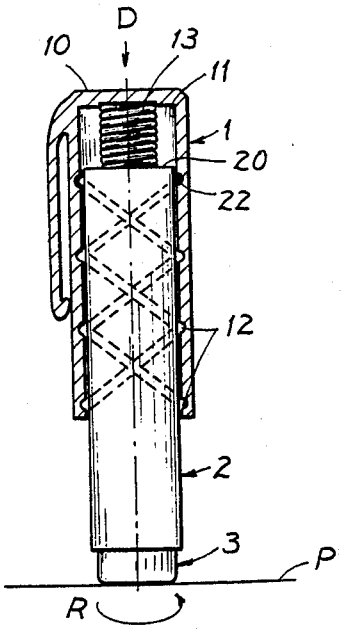
FIG. 4 is an illustration showing an operation of the present invention.

In using the present invention for erasing a mark on a paper as shown in FIG. 4, a user's hand can hold the guiding holder 1 and gradually depress the holder downwardly (D) to let the lower end of the eraser 3 to resiliently contact the erasing mark on the paper. Since the holder 1 is fixedly held by the user's hand, the sleeve means 2 with its beads 22 engageable with the helical grooves 12 of the holder will be helically rotated in the holder to allow the lowest end of the eraser 3 to rotatively rub out the mark on the paper.

After lifting the holder 1 to leave the eraser 3 from the paper P, the restoring spring 13 will automatically extend the sleeve means 2 and the eraser 3 outwardly as shown in FIG. 1 for next erasing operation. When the eraser 3 is partially used, the arm member 42 is depressed to disengage the latch 43 from the latch slot 25 and the arm member 42 is depressed downwardly to push the "fresh" eraser 3 outwardly ready for erasing use.

The arm member 42 is formed with corrugations on the bow-shaped handle 421 for frictional depression of the arm member 42. The diameter of the retainer member 41 secured with the eraser 3 is equal to the diameter of the cylindrical hole 21 of the sleeve means 2 and the diameter of the eraser stick 3 may also be equal to the diameter of the cylindrical hole 21. Since the eraser 3 is made of rubber material, the top end portion of the eraser 3 can therefore be squeezed to insert into the retainer member 41 as shown in FIG. 2 wherein the ratchet teeth 411 of the retainer member 41 will firmly hold the eraser 3. Even the eraser 3 is used up, the eraser positioning means 4 can be retracted beyond the sleeve means 2 for refilling a new eraser stick 3 into the sleeve means 2 for further erasing service.

The present invention can be made in combination with a pencil or ball pen or other stationeries by those skill in the art.

I claim:

1. A rotatively rubbing eraser comprising: a guiding holder generally formed as a cylindrical jacket having a cylindrical hole formed therein, a pair of helical grooves helically formed on a cylindrical wall defining the cylindrical hole of said holder, and a restoring spring having its upper end secured to a top-end plate sealing the cylindrical hole of said holder; an intermediate sleeve means generally formed as a cylindrical tube having a pair of protruding beads formed on two opposite sides of the cylindrical tube engageable with the pair of helical grooves in said holder; and an eraser positioning means secured with an eraser stick adjustably held in said sleeve means, said restoring spring normally tensioning said sleeve means outwardly within said guiding holder, whereby upon a holding and depression of said holder to allow said eraser to resiliently contact a mark on a paper to be erased, said sleeve means will be helically rotated within said holder to allow said eraser to rotatively rub out the mark.

2. A rotatively rubbing eraser according to claim 1, wherein in said intermediate sleeve means is longitudinally formed a longitudinal slot on a longitudinal flat portion recessed from a cylindrical circumference of said cylindrical tube of said sleeve means from a lowest opening of said tube, a plurality of latch slots transversely formed in said tube each latch slot laterally intersecting said longitudinal slot.

3. A rotatively rubbing eraser according to claim 2, wherein said eraser positioning means includes a retainer member secured with said eraser within a cylindrical hole in said sleeve means, a resilient arm member protruding outwardly from said retainer member to form a bow-shaped handle operatively passing through said longitudinal slot in said sleeve means, and a latch formed on a lower end of said arm member engageable with each said latch slot in said sleeve means for securing said eraser in said sleeve means, and depressible inwardly to disengage from said latch slot by squeezing the eraser inwardly for adjustably moving said eraser in said sleeve means.

4. A rotatively rubbing eraser according to claim 3, wherein said resilient arm member is formed with corrugations on said bow-shaped handle.

* * * * *